United States Patent [19]

Audley et al.

[11] Patent Number: 4,946,663

[45] Date of Patent: Aug. 7, 1990

[54] PRODUCTION OF HIGH SURFACE AREA CARBON FIBRES

[75] Inventors: Gary J. Audley; Alan Grint, both of Weybridge, England

[73] Assignee: The British Petroleum Company, p.l.c., London, England

[21] Appl. No.: 258,296

[22] Filed: Oct. 14, 1988

[30] Foreign Application Priority Data

Oct. 15, 1987 [GB] United Kingdom ..... 8724211

[51] Int. Cl.[5] ..... D01F 9/12

[52] U.S. Cl. ..... 423/447.1; 423/460; 423/461; 502/417; 502/427

[58] Field of Search ..... 423/447.1, 460, 461; 502/417, 427

[56] References Cited

U.S. PATENT DOCUMENTS

| | | | |
|---|---|---|---|
| 2,877,176 | 3/1959 | Wolff et al. | 502/427 |
| 3,723,150 | 3/1973 | Druin et al. | 423/447.1 |
| 3,817,874 | 6/1974 | Wennerberg et al. | 423/460 |
| 4,003,979 | 1/1977 | Kanno | 423/239 |
| 4,203,868 | 5/1980 | deJong | 502/427 |
| 4,603,119 | 7/1986 | Karl et al. | 502/417 |
| 4,772,455 | 9/1988 | Izumi et al. | 502/417 |

FOREIGN PATENT DOCUMENTS

| | | | |
|---|---|---|---|
| 55-7513 | 1/1980 | Japan | 423/447.1 |
| 57-32003 | 7/1982 | Japan | 423/460 |
| 58-153537 | 9/1983 | Japan | 502/417 |
| 8701686 | 3/1987 | PCT Int'l Appl. | 423/460 |

*Primary Examiner*—Olik Chaudhuri
*Assistant Examiner*—Robert M. Kunemund
*Attorney, Agent, or Firm*—Larry W. Evans; Joseph G. Curatolo; Sue E. Phillips

[57] ABSTRACT

High surface are carbon fibers are produced by heating carbon fibres in the presence of a quality of alkali metal hydroxide in excess of 50% by weight based on weight of carbon at temperatures of above 500° C. in an inert atmosphere.

13 Claims, No Drawings

PRODUCTION OF HIGH SURFACE AREA CARBON FIBRES

This present invention relates to the preparation of high surface area carbon fibres.

The preparation of activated carbon fibres is disclosed in GB No. 1 301 101 and GB No. 1 310 011. It is stated that the active carbon fibres may be in the form of filaments, of threads or woven or non-woven cloth. The process specifically described shows the conversion of a woven rayon cloth into an active carbon cloth. Such active carbon cloths are available commercially under the designation "charcoal-cloth". The process specifically disclosed is a two stage process in which a carbon fibre precursor e.g. an organic fibrous material, is first carbonised at relatively low temperatures and is then activated by contacting it with carbon dioxide or steam at higher temperatures above 800° C. The activation may be catalysed by various Lewis acids e.g. halides of Ba, Ca, Mg, Al, and Fe.

The maximum specific surface area quoted in the above mentioned patent specifications is 1200 $m^2/g$ (by BET using nitrogen). The corresponding values for commercially available activated carbon cloths (which are believed to be made by the method described in the above mentioned patent specifications) is about 1300 $m^2/g$.

U.S. Pat. No. 4 082 694 discloses a process in which coal or coke is converted to a high surface area active carbon by heating with potassium hydroxide. However, we have found that if we attempt to maximise the surface area of the carbon by increasing the amount of potassium hydroxide used then the result is disintegration of the carbon. Such disintegration would of course not be acceptable in a product which required the fibres to remain intact.

It would be desirable to find a method of making high surface area carbon fibres with particularly high specific surface areas.

According to the present invention the process for the production of high surface area carbon fibres comprises heating carbon fibres in the presence of a quantity of alkali metal hydroxide in excess of 50% wt based on weight of carbon at temperatures above 500° C. in an inert atmosphere.

We have surprisingly found that high surface area carbon fibres can be obtained by the use of quantities of alkali metal hydroxide which would cause disintegration if used to treat a granular carbon product.

The process of the present invention may be used to prepare high surface area carbon fibres either in loose form, in the form of mats or felts, or in the form of woven cloths.

The carbon fibres subjected to the treatment of the present invention may be commercially available high surface area carbon fibres e.g. commercially available "charcoal-cloth". Low surface area carbon fibres suitable for use in the process of the present invention may be prepared by heating a carbon fibre precursor to carbonise it.

Examples of carbon fibre precursors which may be used to prepare the carbon fibres for treatment in accordance with the invention are polymeric organic fibres in particular fibres containing carbohydrate units. An example of such a fibre is rayon which is preferably used in the form of a rayon cloth.

Other examples of suitable carbon fibres are those derived from polyacrylonitrile, isotropic pitch, mesophase pitch, and phenolic resins.

Methods of carbonising such precursors are well known and generally involve heating the carbon fibre precursor in an inert atmosphere.

A commercially available low surface area carbon fibre material which may be used in the present invention is a carbon fibre mat sold by Ashland. This is made by spinning petroleum pitch into fibres. The fibres are oxidised in air to give them thermosetting properties, and then carbonised at about 1000° C. to produce the final carbon fibre.

The preparation of the carbon fibre to be treated in accordance with the present invention is preferably carried out completely separately from the treatment step. Where the alkali metal hydroxide causes breakdown of the fibre precursor, it will be necessary to apply the treatment with alkali metal hydroxide to the pre-formed carbon fibre.

The processes for the production of high surface area carbon clothes give rise to a loss of carbon. This may be measured by the carbon yield which is the weight of carbon present in the cloth after carbonisation compared with the weight of carbon (combined carbon) in the cloth before carbonisation. The carbon yield may be increased by incorporating additives into the material to be carbonised e.g. $ZnCl_2$ may be incorporated into viscose rayon cloth by immersing the cloth in an aqueous solution of $ZnCl_2$ (e.g. 5–10% weight solutions), removing surplus water and then drying. This is preferably carried out before deposition of the alkali metal hydroxide.

The alkali metal hydroxide is preferably KOH or a low melting point mixture (e.g. melting below 200° C.) containing KOH e.g. a KOH:NaOH mixture having a composition in the mole ratio 1:9 to 9:1.

The quantity of alkali metal hydroxide used in relation to the carbon fibres to be activated is preferably in the range 50 to 1000% more preferably 200% to 100% wt., and more preferably 200% to 600%.

In order to distribute the alkali metal hydroxide more evenly on the carbon it is preferred to mix the carbon fibres with a solution of alkali metal hydroxide in a solvent e.g. water and then to remove the solvent before carbonisation.

The process of the present invention is carried out at temperatures above 500° C., but preferably not above 2000° C., more preferably at temperatures in the range 600° C. to 1000° C.

The process of the present invention is conveniently carried out at atmospheric pressure.

Particularly preferred temperatures are those in the range 800°–1000° C. The duration of the heating step i.e. the maintenance of material above 500° C. is preferably in the range 5 to 120 minutes, more preferably 60 to 90 minutes. The process is carried out in flowing or static inert atmosphere, e.g. nitrogen.

The carbon cloth after the treatment step is preferably allowed to cool to below 100° C., preferably below 50° C., more preferably below 30° C., before coming into contact with a non-inert atmosphere e.g. air.

The carbon cloth is preferably washed, e.g. with water or dilute acid, to remove the alkali metal hydroxide. Any solvent remaining on the cloth after washing may be removed by drying.

The invention will now be described by reference to the following examples.

COMPARATIVE TEST A

A sample of a viscose rayon cloth was placed in an oven where it was maintained under a flowing nitrogen atmosphere while being heated at a rate of 5° C./minute to 800° C. The cloth was allowed to remain at this temperature for 15 minutes. It was then allowed to cool to 20° C. and removed from the oven. The BET surface area and micropore volume were determined by nitrogen absorption at 77° K. The results are shown in Table 1.

EXAMPLE 1

The carbon cloth produced in Example 1 was placed in a vessel with an equal weight of KOH pellets (containing ca. 20% wt of water) to give a weight ratio of carbon to KOH pellets of 1:0.8. An excess of water was then added to completely dissolve the KOH pellets. The cloth was gently stirred in the KOH solution until it was completely wetted. The vessel was then introduced into a drying oven when it was maintained at 100° C. under a pressure of 500 mbar (0.05 MPa) of nitrogen and left overnight to remove all the water. This method ensured an even distribution of KOH over the surface of cloth. It was introduced into an oven in which an atmosphere of flowing nitrogen was maintained and was heated at the rate of 5° C./minutes to 850° C. and was maintained at this temperature for 1½ hours. It was then allowed to cool to 20° C. The cloth was then washed with an excess of distilled water and dried at 100° C. under reduced pressure. The BET surface area and micropore volume were determined as in Comparative Test A. The results are given in Table 1.

EXAMPLES 2–4

Experiments were carried out as in Example 1 except that the weight of KOH used was respectively 2,4 and 6 times the weight of the carbonised cloth. The results are given in Table 1.

COMPARATIVE TEST B

A commercially available carbon fibre mat sold by the firm of Ashland was tested for BET surface area and micropore volume as in Comparative Test A. The results are given in Table 2.

EXAMPLE 5–7

These Examples were carried out in the same way as the corresponding Examples 2, 3 and 4 except that the carbon fibre mat was only heated to 800° C. The results are shown in Table 2.

These experiments clearly show the very high surface areas which are obtainable by the process of the present invention indicated by the high micropore volumes obtained.

TABLE 1

| Experiment | KOH wt % | BET $N_2$ Surface Area/$m^2$/g | Micropore Volume $cm^3$/g |
|---|---|---|---|
| A | 0 | 253 | 0.08 |
| 1 | 100 | 1386 | 0.48 |
| 2 | 200 | 1816 | 0.65 |
| 3 | 400 | 2589 | 1.06 |
| 4 | 600 | 2826 | 1.25 |

TABLE 2

| Experiment | KOH wt % | BET $N_2$ Surface Area/$m^2$/g | Micropore Volume $cm^3$/g |
|---|---|---|---|
| B | 0 | <1 | <0.01 |
| 5 | 200 | 1129 | 0.39 |
| 6 | 400 | 1828 | 0.78 |
| 7 | 600 | 2257 | 1.00 |

COMPARATIVE TEST C

This is a comparative test, not according to the invention, showing this effect of using large amounts of alkali metal hydroxide to treat carbon in granular form, namely anthracite.

A batch of anthracite from the Cynheidre Mine, South Wales, was sieved to give particles in the size range of 1–2 mm. A five gram sample of this anthracite was mixed with its own weight of molten KOH pellets at 150°–200° C. (N.B. $H_2O$ in KOH pellets lowers effective m.pt. from ca. 400° C. for dry KOH to around 150° C.). The anthracite was well stirred until completely wetted by the concentrated KOH solution. The mixture was allowed to cool and set. This method ensures a good intimate mixing between the anthracite and the KOH. The mixture was then heated in an atmosphere of flowing nitrogen at a rate of 0.5° C./min until temperature of 850° C. was reached. The rate of temperature increase was set at 0.5° C./min and not 5° C./min as in the other experiments because we have found that high rates of heating promote break down of the granules. The carbon was allowed to remain at 850° C. for 1½ hours before being cooled to 20° C.

The sample was washed with dilute acid (2 M hydrochloric acid) to remove any residual potassium salts. Dilutes acid serves to remove residual potassium salts from the carbon but does not affect the particle size.

The resultant carbon was then sieved to determine the particle size distribution. The results are given in Table 3.

TABLE 3

| Sieve Fraction | Test C | Test D |
|---|---|---|
| >1000 μm | 4% | — |
| 710–1000 μm | 13% | — |
| 300–710 μm | 73% | 5% |
| <300 μm | 10% | 95% |

COMPARATIVE TEST D

Test C was repeated but using a weight of KOH pellets which was four times the weight of anthracite used. The other results are shown in Table 3.

Table 3 shows that considerable breakdown of the carbon particles took place. It should be noted that even more breakdown would be expected if the same heating rates had been used as had been used in the other experiments.

We claim:

1. The process for the production of high surface area carbon fibres which comprises heating carbon fibres in the presence of a quantity of alkali metal hydroxide in the range of 200%–1000% by weight based on weight of carbon at temperatures above 500° C. in an inert atmosphere.

2. A process according to claim 1 wherein the carbon fibres are derived from a polymeric organic fibre containing carbohydrate units.

3. A process according to claim 2 wherein the fibre is rayon.

4. A process according to claim 1 wherein the fibre is in the form of a woven cloth.

5. A process according to claim 1 wherein the carbon fibre is a carbon fibre mat produced by spinning petroleum pitch into fibres, oxidising the fibres and then carbonising.

6. A process according to claim 1 wherein the alkali metal hydroxide is KOH.

7. A process according to claim 1 wherein the alkali metal hydroxide is a mixture melting below 200° C. containing KOH.

8. A process according to claim 7 wherein the mixture comprises KOH and NaOH in a molar ratio of 1:9 to 9:1.

9. The process according to claim 1 wherein the quantity of alkali metal hydroxide is in the range 200%–600% weight.

10. The process according to claim 1 wherein the carbon is treated with a solution of alkali metal hydroxide and solvent is removed before heating at temperatures above 500° C. in an inert atmosphere.

11. The process according to claim 1 wherein the alkali metal hydroxide and the carbon fibres are heated together at a temperature in the range 600° C. to 1000° C.

12. The process according to claim 1 wherein the carbon fibres are heated together with the alkali metal hydroxide at a temperature above 500° C. for a time in the range 5 to 120 minutes.

13. A process according to claim 2 wherein the alkali metal hydroxide is KOH.

* * * * *